US006378651B1

(12) United States Patent
Ecker et al.

(10) Patent No.: US 6,378,651 B1
(45) Date of Patent: Apr. 30, 2002

(54) HORIZONTAL LIFELINE FALL ARREST SYSTEM

(75) Inventors: Tim Wayne Ecker, Thornton; Richard Gregory Reynolds, Arvada, both of CO (US)

(73) Assignee: Rose Manufacturing Company, Englewood, CO (US)

( * ) Notice: Subject to any disclaimer, the term of this patent is extended or adjusted under 35 U.S.C. 154(b) by 0 days.

(21) Appl. No.: 09/591,515

(22) Filed: Jun. 9, 2000

Related U.S. Application Data

(60) Provisional application No. 60/159,302, filed on Oct. 14, 1999.

(51) Int. Cl.[7] ..... A46B 37/00
(52) U.S. Cl. ..... 182/36; 104/115
(58) Field of Search ..... 182/36, 3; 104/182, 104/115

(56) References Cited

U.S. PATENT DOCUMENTS 141,757 A * 8/1873 Bunster
1,296,571 A * 3/1919 Tripp
5,979,599 A * 11/1999 Noles ..... 182/36

* cited by examiner

*Primary Examiner*—Alvin Chin-Shue
(74) *Attorney, Agent, or Firm*—James G. Uber, Esq.

(57) ABSTRACT

A fall arrest system for a worker connected to a horizontal lifeline supported by at least one intermediate support having a pair of rotatable star wheels for supporting the lifeline. A glider connector connects a worker to the lifeline so that the glider connector slides along the lifeline as the worker walks parallel thereto. The glider connector which is supported by rails as it passes near the intermediate support rotates the star wheels as it passes through spaces between their projections to allow the glider connector to pass through the intermediate support without having to disconnect it from the lifeline.

6 Claims, 3 Drawing Sheets

HORIZONTAL LIFELINE FALL ARREST SYSTEM

This Appln claims benefit of Prov. No. 60/159,302 filed Oct. 14, 1999.

FIELD OF THE INVENTION

This invention relates generally to a fall-arrest system and more particularly to a system having an intermediate support for a horizontal lifeline and a worker's lifeline connector which allows the connector to pass through the intermediate support without disconnecting and reconnecting around the support.

BACKGROUND OF THE INVENTION

Under normal working conditions, a worker on a scaffold, catwalk or other walkway positioned in a relatively high place where a fall could result in serious injury, will wear some type of safety harness which is slidingly coupled to a horizontal lifeline. Typically, the horizontal lifeline is connected between two anchor supports. Either one of two known methods is used to eliminate sag in the lifeline. One known method is to tighten the lifeline until all sag has been eliminated. However, this method can produce very large forces on the anchor supports which may not be acceptable. Another known method is to use intermediate supports. The intermediate supports divide the span into a plurality of smaller spans so less force is needed at the anchor supports. One such intermediate support device is illustrated in U.S. Pat. No. 4,584,945 which shows a system for transferring a load across a corner support for a lifeline using a rotatable wheel having a plurality of projections and a cooperating sliding element. The sliding element, not the rotatable wheel, supports the lifeline as a worker's lifeline connector slides along the lifeline over the sliding element and rotates the wheel. The rotatable wheel is attached to an anchor support through its axle which allows the worker to pass back and forth around the support. A disadvantage associated with this type of system is a low strength rating. The sliding element is attached to the rotating wheel by steel tabs which must bear a worker's weight when the worker falls, thus limiting the system to two workers at a time.

Another type of intermediate support device is illustrated in U.S. Pat. No. 5,343,975 in which a long tube protrudes from an anchor bar support to support a lifeline. As a C-shaped worker's connector nears the support, the cammed edge on the connector rotates the connector so the opening of the C matches the anchor bar. The anchor bar support is designed to deform during a fall to absorb energy. One disadvantage associated with this type of system is the down time required after a worker falls. All of the anchor bar supports must be removed and replaced by the manufacturer before workers can use the lifeline again.

A need therefore exists for a fall-arrest system having an increased strength rating and a decreased down time in the event of a fall.

SUMMARY OF THE INVENTION

According to the present invention, there is provided a fall arrest system for a horizontal lifeline in which a rotatable star wheel mounted on an anchor body contacts and supports the horizontal lifeline. Preferably there is a pair of cooperating rotatable star wheels which contact and support the horizontal lifeline at intermediate points such that a glider connector attached to a worker's lifeline may pass through the rotatable star wheels. The rotatable star wheels are fixed to an intermediate anchor support and are angled relative to each other. A plurality of projections of the star wheels mesh together somewhat like a gear and form a V on which the lifeline is directly supported. At least one rail provided on the intermediate anchor support lifts at least one wheel of a glider connector off of the lifeline as the glider connector nears the intermediate anchor support body. Once the glider connector has sufficiently moved up the at least one rail, an arm of the glider connector contacts the projections of the star wheels.

As the worker walks parallel to the lifeline, the force of the moving worker is greater than the friction on the star wheels (due to the weight of the lifeline) causing the star wheels to rotate while the glider connector moves. As the star wheels rotate, a space is created between the projections of one star wheel relative to the other star wheel. The glider connector arm will move through the projections in this space. Once the star wheels have rotated sufficiently so that there are no projections contacting the glider connector arm anymore, the glider connector will continue to roll down the at least one rail and back onto the lifeline.

The system of the present invention provides increased strength and allows up to five workers on a single lifeline, with a maximum of two workers on a span. Additionally, the system allows for a single worker fall with no permanent deformation of the intermediate support. This greatly reduces the amount of time the system will be out of use after a worker fall. The present invention requires little more than inspection by a qualified person before being brought back into use after a single worker fall.

BRIEF DESCRIPTION OF THE DRAWINGS

The present invention and its presently preferred embodiments will be better understood by way of reference to the detailed disclosure herebelow and to the accompanying drawings, wherein.

DETAILED DESCRIPTION OF THE INVENTION

Figure 1:
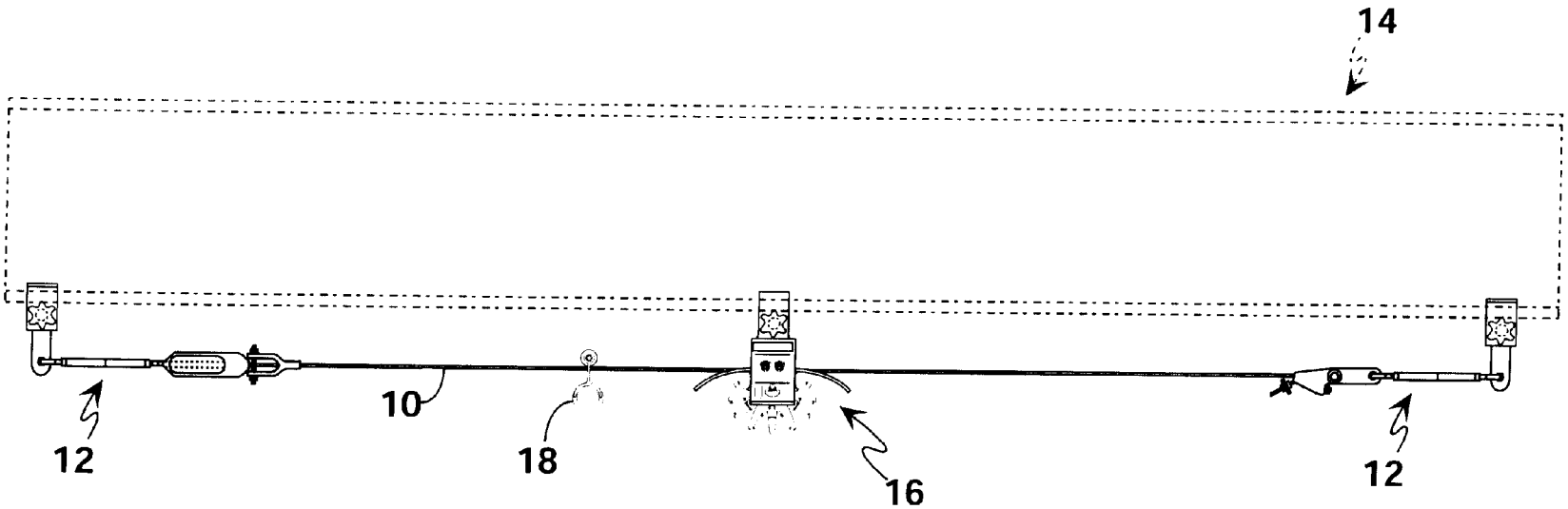
FIG. 1 is a side view of the system according to the present invention.

In FIG. 1 there is illustrated one use of the present invention. A horizontal lifeline 10 is connected between two anchor supports 12 attached to a horizontal beam 14. At least one intermediate anchor support 16 is also supported on the horizontal beam 14 for supporting the lifeline 10 intermediate the two anchor supports 12 and thus dividing the lifeline 10 into a plurality of spans. Also provided is a glider connector 18 for slideably connecting a lanyard (not shown) attached to the harness (not shown) of a worker to the lifeline 10 so that the worker may walk parallel to the lifeline 10.

Figure 3:
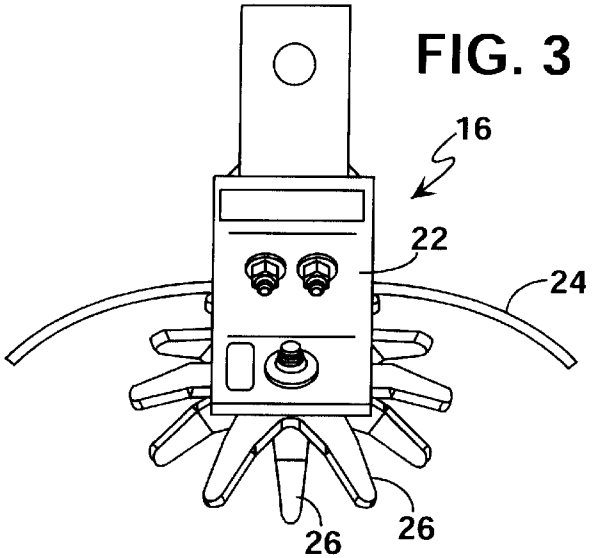
FIG. 3 is a side view of the intermediate support of FIG. 2.
Figure 4:
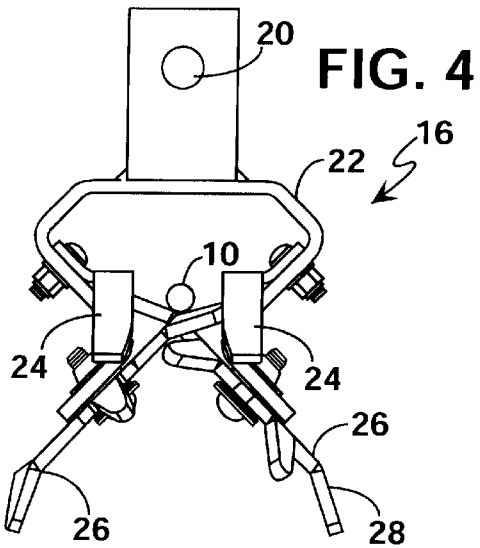
FIG. 4 is a front end view of the intermediate support of FIG. 2.
Figure 2:
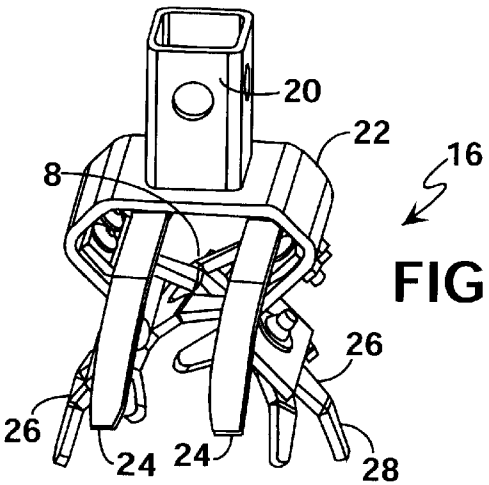
FIG. 2 is a perspective view of the intermediate support of the present invention.

In FIGS. 2–4, there is illustrated details of the preferred construction of the intermediate anchorage support 16. The anchorage support 16 has an upper bracket 20 for operatively connecting to the beam 14. A lower substantially U-shaped bracket 22 has attached to it a pair of parallel rails 24 and a pair of rotatable star wheels 26. Each of the star wheels 26 has a plurality of radially spaced projections 28 which when rotated mesh with the projections 28 from the other star wheel forming an arcing motion inside the bracket 22. The star wheels 26 are mounted at an angle to each other such that imaginary lines drawn through the axis of each star wheel 26 intersect at a point below the meshing of the projections 28. The meshing of the projections 28 forms a V in which the lifeline 10 is supported (FIG. 4). While the preferred embodiment is a star wheel with six projections, a smaller or larger number of projections could also be used.

Figure 5:
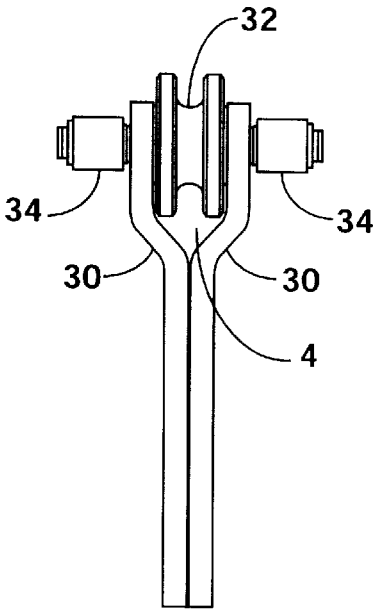
FIG. 5 is a front end view of the glider of the present invention.
Figure 6:
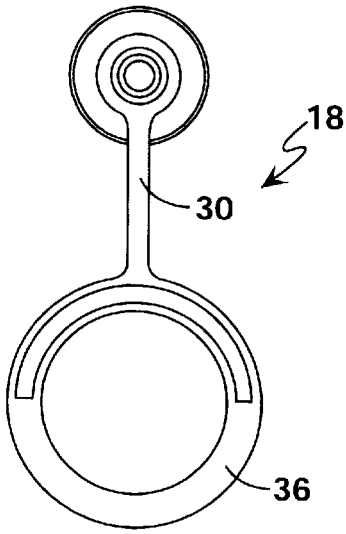
FIG. 6 is a side view of the glider of the present invention.

In FIGS. 5–6, there is illustrated details of the preferred construction of the glider connector 18. The glider connector 18 comprises a pair of arms 30 which are divided at their upper ends by a pulley 32. Mounted on the same axis of the pulley 32 and on the outside of the pair of arms 30 are two wheels 34. At their lower end, the pair of arms 30 form a circular connector 36 for attaching to a worker's lanyard (not shown).

In operation, as a worker walks parallel to the lifeline 10, the pulley 32 of glider connector 18 rolls along the lifeline 10. As the glider connector 18 approaches the intermediate anchor support 16 the pair of rails 24 provided on the intermediate anchor support 16 lift the wheels 34 of the glider connector 18 so that the pulley 32 lifts off of the lifeline 10. Once the glider connector 18 has sufficiently moved up the rails 24, the pair of arms 30 of the glider connector 18 contact the projections 28 of the star wheels 26. As the worker continues to walk parallel to the lifeline 10, the force of the moving worker is greater than the friction on the star wheel 26 from the weight of the lifeline 10 causing the star wheels 26 to begin to rotate while the glider connector 18 moves. As the star wheels 26 rotate, a space is created between the projections 28 of each star wheel 26 relative to the other star wheel 26. The glider connector arms 30 will move through the projections 28 in this space. Once the star wheels 26 have rotated sufficiently so that there are no projections 28 contacting the glider connector arms 30 anymore, the glider connector wheels 34 will continue to roll down the rails 24 until the pulley 32 is again supported on the lifeline 10.

Figure 7:
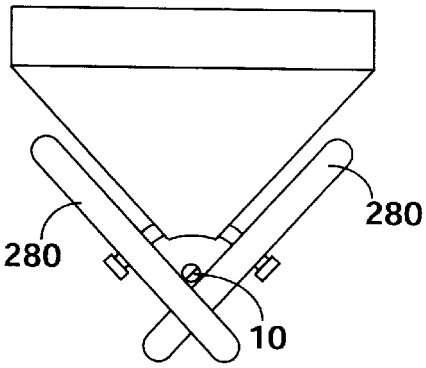
FIG. 7 is a front end view of an intermediate support of an alternate embodiment.
Figure 8:
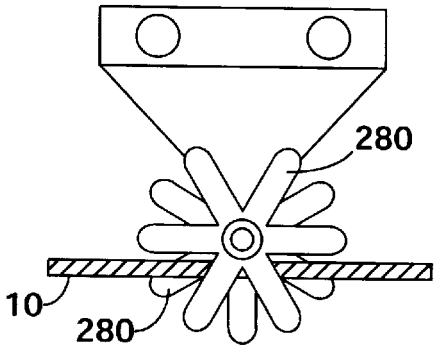
FIG. 8 is a side view of the intermediate support of FIG. 7.

FIGS. 7 and 8 illustrate an alternate embodiment of the present invention in which the star wheels are mounted at an angle such that imaginary lines drawn through the axes of the star wheels intersect at a point above the meshing of the projections. The lifeline 10 rests on and is supported by the star wheels which intersect and mesh to form a V. This embodiment, however, has been found to have decreased strength as compared to the embodiment illustrated in FIGS. 2–4.

If not otherwise stated herein, it may be assumed that all components and/or processes described heretofore may, if appropriate, be considered to be interchangeable with similar components and/or processes disclosed elsewhere in the specification, unless an indication is made to the contrary.

If not otherwise stated herein, any and all patents, patent publications, articles and other printed publications discussed or mentioned herein are hereby incorporated by reference as if set forth in their entirety herein.

It should be appreciated that the apparatus and methods of the present invention may be configured and conducted as appropriate for the application. The embodiments described above are to be considered in all respects only as illustrative and not restrictive. The scope of the invention is defined by the following claims rather than by the foregoing description. All changes, which come within the meaning and range of equivalency of the claims, are to be embraced within their scope.

What is claimed is:

1. A fall arrest system comprising: a horizontal lifeline; a connector slideably supported on the horizontal lifeline; and at least one intermediate support for the horizontal lifeline, each of the at least one intermediate supports comprising:

an anchor body having a substantially u-shaped bracket;

a pair of rotatable star wheels having a plurality of projections, the projections from one star wheel meshing with the projections from the other star wheel within the bracket to support the horizontal lifeline while permitting the connector to pass there-through; and each star wheel being mounted on the bracket at an angle to each other such that the projections of each star wheel, when supporting the horizontal lifeline, may in turn be supported by the bracket if the projections are deformed by a load being applied to the horizontal lifeline.

2. The fall arrest system of claim 1 wherein the connector comprises a pulley for rolling support on the horizontal lifeline.

3. The fall arrest system of claim 2 wherein the connector further comprises a plurality of wheels for rolling support on a plurality of rails mounted on the anchor body above the projections of the star wheels.

4. The fall arrest system of claim 1 wherein each star wheel has at least six projections.

5. An intermediate support for a horizontal lifeline comprising:

an anchor body having a substantially u-shaped bracket;

a pair of rotatable star wheels having a plurality of projections, the projections from one star wheel meshing with the projections from the other star wheel within the bracket to support the horizontal lifeline; and each star wheel being mounted on the bracket at an angle to each other such that the projections of each star wheel, when supporting the horizontal lifeline, may in turn be supported by the bracket if the projections are deformed by a load being applied to the horizontal lifeline.

6. The fall arrest system of claim 5 wherein each star wheel has at least six projections.

* * * * *